United States Patent [19]

Fukuda

[11] 3,959,950

[45] June 1, 1976

[54] PACKAGING SYSTEM

[76] Inventor: Nobuyoshi Fukuda, 27-4 Betsusho 2 chome, Urawa, Saitama, Japan

[22] Filed: Mar. 17, 1975

[21] Appl. No.: 558,890

[52] U.S. Cl. ..... 53/37; 53/374; 93/49 R

[51] Int. Cl.[2] ..... B65B 5/04; B65B 7/20

[58] Field of Search ..... 53/37, 284, 374; 93/49 R, 49 M; 206/320

[56] References Cited

UNITED STATES PATENTS

| | | | |
|---|---|---|---|
| 2,902,810 | 9/1959 | McGihon | 53/374 |
| 2,929,183 | 3/1960 | Magna | 53/374 |
| 2,939,260 | 6/1960 | Ogle et al. | 53/374 |
| 3,077,062 | 2/1963 | Brumbaugh | 53/37 |
| 3,183,639 | 5/1965 | Rodman | 53/374 |

*Primary Examiner*—Robert L. Spruill

[57] ABSTRACT

A packaging system for receiving an article into an open, rectangular foldable container without lifting the article relative to the container. The open foldable containers include four vertical walls, a pair of bottom end flaps depending from a pair of walls, and a pair of bottom side flaps depending from the other pair of walls. The pair of bottom end flaps are formed with at least two vertically extending slots which are spaced apart from each other. Each of the bottom flap members is initially coplanar with the respective walls, with the bottom of the container being open. The packaging machine includes a conveyor system including a number of chains which are equal to the number of slots formed in the bottom end flaps of the container, the chains extending parallel to each other and are spaced apart so as to correspond to the spacing of the slots. An article to be packaged is introduced onto the conveyor system, and the container is placed therearound with the container oriented such that the pair of bottom end flaps are distributed in vertical planes perpendicular to the length of the chains and with the slots in the pair of bottom end flaps being fitted over the respective chains. The packaging machine also includes means located along the conveyor system for folding the pair of bottom end flaps to a closed position while the container is placed around the article on the chains. The pair of bottom side flaps of the container are then folded to a closed position by known folding means.

7 Claims, 10 Drawing Figures

1
2
3
3a
3b
3c
4
4a
4b
4c
5
6
7
8
9
10
11
12
13a
13b
14a
14b
15

PACKAGING SYSTEM

The invention relates to a packaging system, and more particularly to a packaging system for receiving a relatively large and heavy article into a rectangular foldable container during its conveyance without lifting the article relative to the container.

A conventional foldable container is manufactured from a single piece of cardboard, corrugated board or the like, cut into a predetermined pattern and provided with indented fold lines. Upper and bottom flap members which are to be folded extend from the upper and lower edges of the walls which define the body of the container. During the shipment or storage of the containers, a container manufacturer maintains these flap members coplanar with the walls of the container and in overlapping relationship with each other in order to minimize the space occupied. When a user receives a container in this configuration, he opens it to a rectangular shape, and folds the bottom flap members to a closed position. The bottom flap members include a pair of end flaps and a pair of side flaps which, when folded, are maintained in the closed position by a strip of gummed tape or stapling. In the conventional use of such a foldable container, the bottom flap members are previously folded, an article is placed therein, and subsequently the upper flap members are set up. The bottom flap members can be automatically folded as disclosed in U.S. Pat. No. 3,435,738 issued April 1, 1969 to Joseph C. Berney. However, one of the problems with a prior art packaging system is the fact that where a relatively large and heavy article such as an electrical refrigerator or an electrical washing machine is to be packaged, such article must be hoisted by a crane in order to place it into the container. Such products are often carried on a conveyor from the production line, and therefore it is readily seen that the necessity of a crane for the packaging step is not desirable.

Therefore, it is an object of the invention to provide a packaging system which permits an article to be received within a foldable container without lifting the article relative to the container.

It is a specific object of the invention to provide a packaging system having a conveyor system which can be conveniently connected with the production line for the articles.

The packaging system according to the invention is characterized by the fact that a open foldable container is placed over and around an article and then the bottom flap members of the container are folded during the movement or transfer of the article. The term "open foldable" container as used herein refers to an open container having its opposing wall edges joined together but in which the upper and bottom flap members extending from the upper and lower edges of the walls are substantially planar with the respective walls. In other words, when a user opens a knocked-down container, or a container in its folded configuration in which opposing walls of the container are flat against each other, to a rectangular shape, the top and bottom thereof remain open.

With the packaging system of the invention, when the folding of the bottom flap members is completed, the article is confined within the container. To achieve such result, the known foldable container must be modified. Specifically, the foldable container used in the present invention includes, in its bottom portion, a pair of side flaps which are constructed in a similar manner as those of a usual foldable container, and also a pair of end flaps extending in a direction perpendicular thereto which are provided with a plurality of, preferably two, slots. As used herein, the term "side flap" refers to that flap which is disposed parallel to the direction of travel of the container when the container is placed over and around the article and moves therewith. The term "end flap" refers to a flap which extends in a direction perpendicular to the direction of travel of the container. For the convenience of description, it is assumed that each of the bottom end flaps is formed with two slots, dividing each end flap into three segments.

In accordance with the invention, an article is loaded on a pair of parallel chain conveyors, and an open foldable container is placed therearound from above, with the container oriented in a manner such that the pair of bottom end flaps extend in a direction perpendicular to the length of the chain conveyor and with the incisions in the end flaps being fitted over the respective chain conveyors. As a result, the pair of bottom end flaps have their segments distributed below the level of the chain conveyors. The foldable container is folded by initially folding the pair of end flaps to a closed position and then folding the pair of side flaps to a closed position. The initial folding operation can be performed by a known closer, and the subsequent folding operation can be performed by known plow means. However, in contradistinction to the operation performed in a conventional set-up apparatus, these folding operations are performed in accordance with the invention on a container placed over and around the article during the time it runs together with the article carried on the conveyors, and thus there is achieved an advantageous result that the article is received within the container when the set-up operation is completed. To this end, the upper flap members can be folded simultaneously with the folding of the bottom flap members.

The above and other objects, features and advantages of the invention will be more completely appreciated from the following detailed description of an embodiment thereof shown in the attached drawings, in which:

FIGS. 1*a* to 1*e* are perspective views illustrating the process of setting up a foldable container in accordance with the packaging system of the invention;

Figures 1A, 1B, 1C, 1D, 1E:
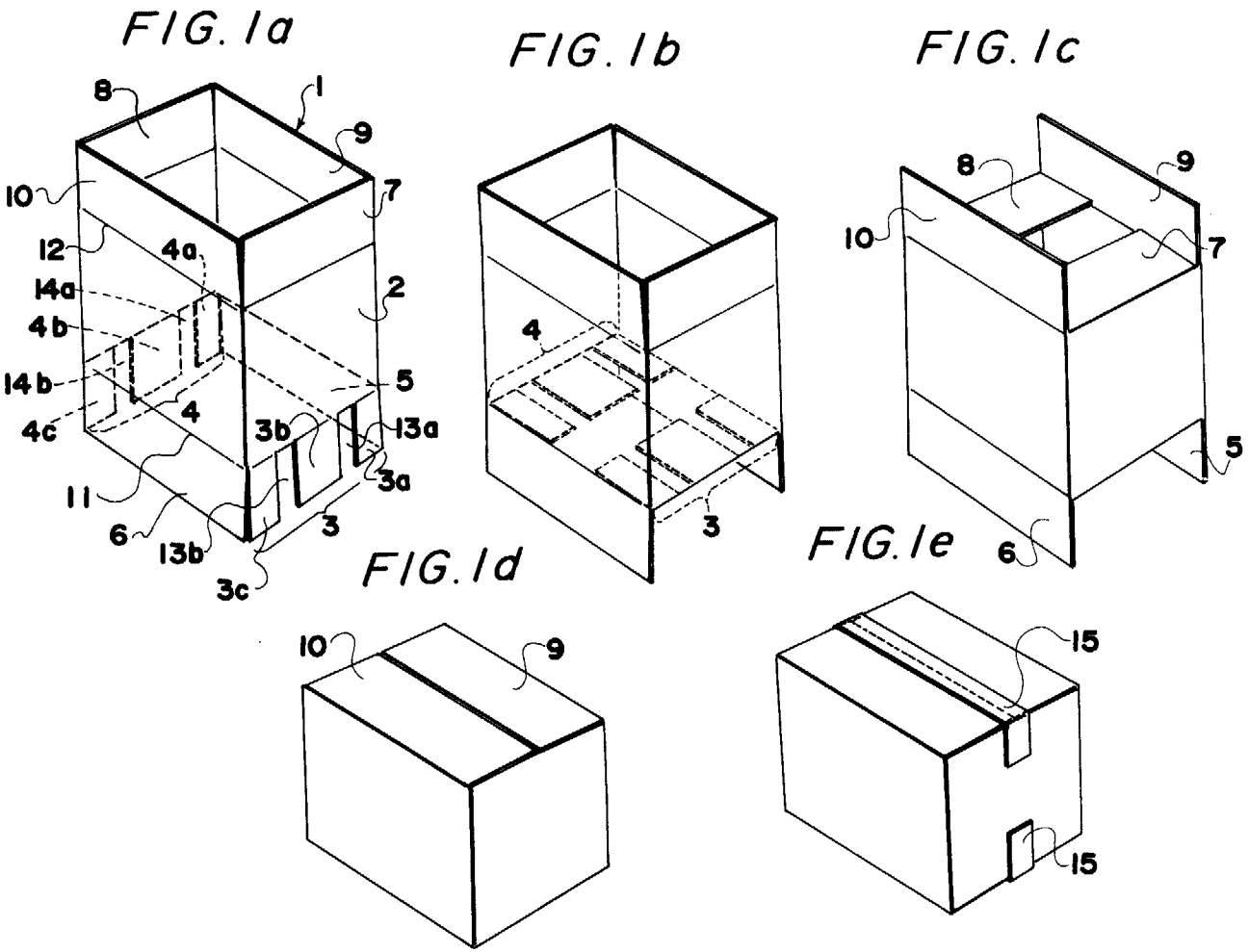

Reference to FIGS. 1*a* to 1*e* will clearly show the manner in which an open foldable container 1 is folded in accordance with the invention. It should be understood that the folding operation will be described below on the assumption that both the upper and lower flap members are folded simultaneously. The foldable container 1 includes four walls 2 which are adapted to define a rectangular space. A pair of bottom end flaps 3, 4 and a pair of bottom side flaps 5, 6 are integral with and extend downwardly from these walls 2. Similarly, a pair of upper end flaps 7, 8 and a pair of upper side flaps 9, 10 are integral with and extend upwardly from the walls 2. Fold lines 11 are indented between the walls 2 and the bottom flap members 3 to 6, and similarly fold lines 12 are indented between the walls 2 and the upper flap members 7 to 10. As is well known, such a foldable container is formed of a piece of cardboard or other similar material, but in accordance with the invention, the pair of bottom end flaps 3, 4 are each formed with a pair of slots 13*a*, 13*b* and 14*a*, 14*b*, respectively. These slots 13*a*, 13*b* and 14*a*, 14*b* are deep enough to reach the fold lines 11. As a result, each of the bottom end flaps 3, 4 are divided into three segments 3*a* to 3*c* and 4*a* to 4*c*, respectively. While the open container 1 is shown in FIG. 1*a*, one advantage of the invention which results from placing the container 1 initially over and around an article to be packaged is the fact that the upper flap members may be simultaneously folded during the folding of the bottom flap members. Specifically, the bottom end flaps 3, 4 are initially folded (FIG. 1*b*), then the upper end flaps 7, 8 are folded (FIG. 1*c*), and subsequently both the bottom and upper side flaps 5, 6 and 9, 10 are folded to a closed position (FIG. 1*d*). The container is maintained in the closed position by application of a gummed or adhesive tape 15 as shown in FIG. 1*e*. Such a packaging process is realized through the use of a foldable container constructed in accordance with the invention, and of a packaging machine to be described later.

Figure 2:
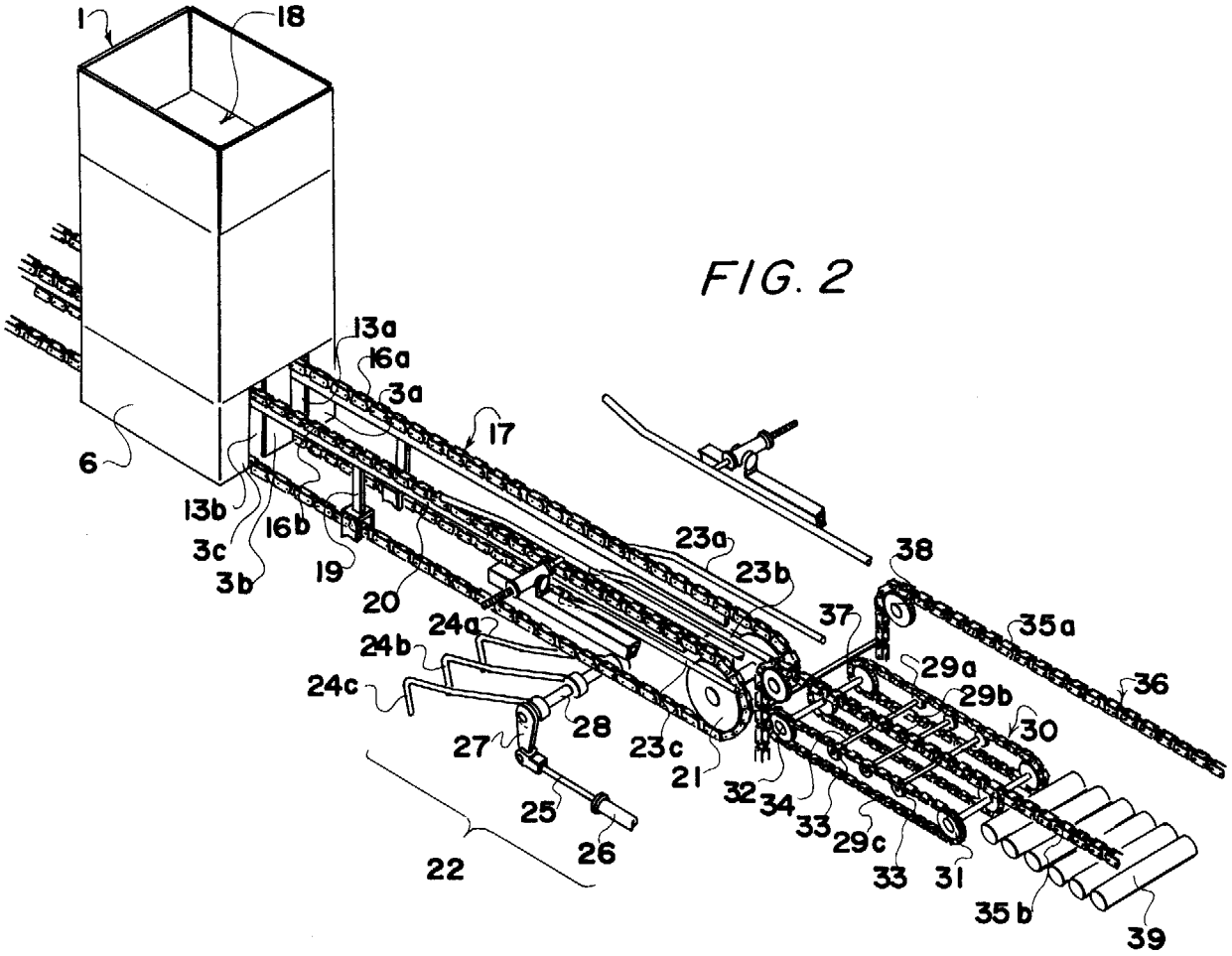
FIG. 2 is a perspective view illustrating the first and second zones of the packaging system according to the invention.
Figure 4:
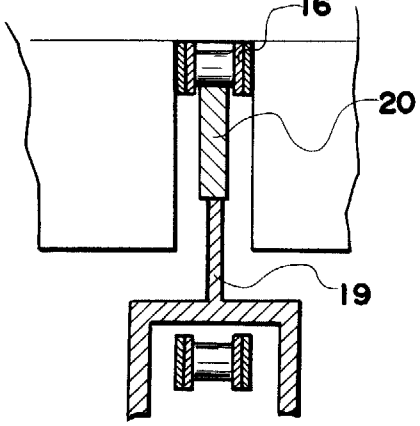
FIG. 4 is a fragmentary cross section of the conveyor system shown in FIG. 2.
Figure 3:
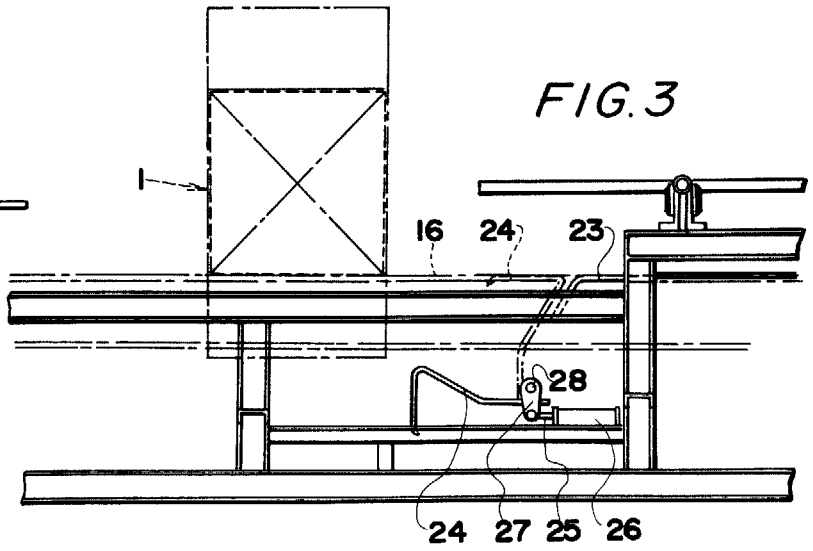
FIG. 3 is a side elevation of the first zone shown in FIG. 2.
Figure 6:
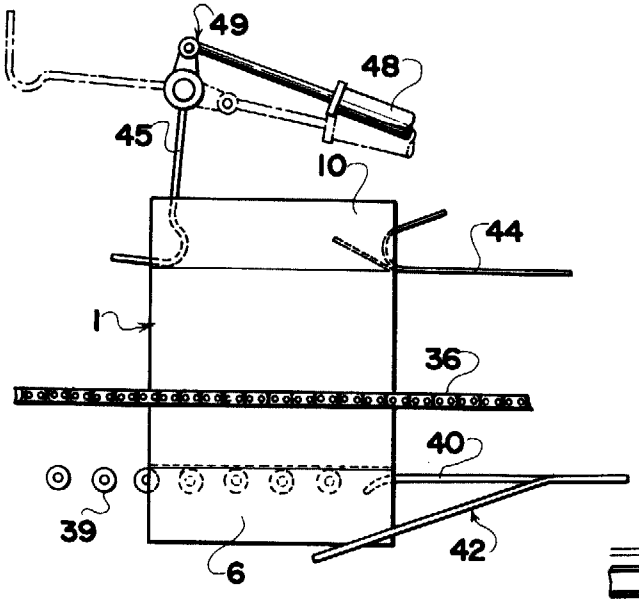
FIG. 6 is a side elevation of the third zone shown in FIG. 5.
Figure 5:
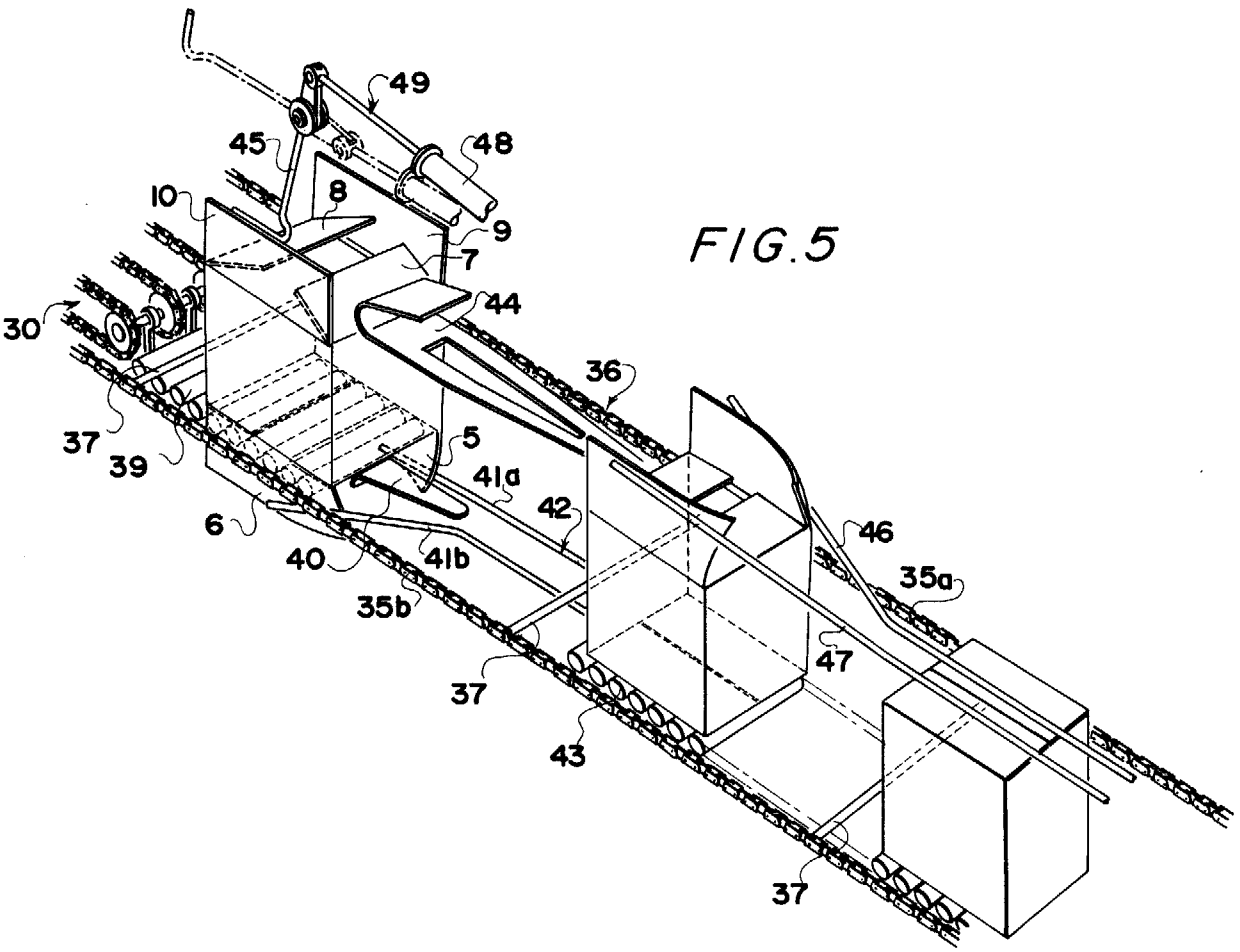
FIG. 5 is a perspective view illustrating the third zone of the packaging system according to the invention.

FIGS. 2 to 6 illustrate various parts of the packaging machine according to the invention, and a general perspective can be gained by placing FIG. 5 to the right of FIG. 2 in a slightly overlapping relationship. The packaging machine includes first, second and third zones. The first zone comprises a conveyor system 17 which includes a pair of endless chains or tracks 16a, 16b for carrying an article thereon. The rear portion of the conveyor system constitute a station where an open container is placed over and around an article 18 while the forward portion forms a station where the pair of bottom end flaps 3, 4 of the container 1 are folded to a closed position. In FIG. 2, the open container 1 is shown in place over the article 18 which is mounted on the conveyor system 17. To permit a loading of the article 18 thereon, the conveyor system 17 is provided with a support rail 20 having a stanchion 19. As will be evident from FIG. 4, the support rail 20 is in sliding contact with the bottom surface of the chain 16 for carrying the weight of the article 18 placed thereof. The conveyor system 17 may comprise a last stage conveyor of the production line for the articles 18, or may be a separate conveyor which is connected with the production line. It is desirable that the conveyor system be continuously driven at a uniform speed by means of sprocket gears 21 having a common axle.

A closer 22 for the pair of bottom end flaps 3, 4 of the container 1 is mounted on the forward station of the first zone. The closer 22 functions to cause the bottom portion of the article 18 which is loaded on the conveyor system 17 to be covered with the pair of bottom end flaps 3, 4 of the container 1, and may comprise a conventional design. However, in a preferred arrangement, the closer 22 includes a plurality of rods 23*a* to 23*c* for closing the respective segments 3*a* to 3*c* of the forward end flap 3, and a plurality of lever arms 24*a* to 24*c* for closing the respective segments 4*a* to 4*c* of the rear end flap 4. The rods 23a to 23c are disposed in the same plane as that of the loading surface of the conveyor system 17, and have their end portions inclined downwardly (see FIG. 3). The rods 23a to 23c having these inclined forward end portions serve to guide and maintain the segments 3*a* to 3*c* of the forward bottom end flap 3 of the container 1 to a closed position as it is conveyed together with the article 18. The closer 22 also includes a double acting cylinder unit 26 having a piston rod 25, and a crank arm 27 fixedly mounted on a shaft 28 and operatively connected with the piston rod 25. The shaft 28 is connected with the lever arms 24*a* to 24*c*, which are controlled by the double acting cylinder unit 26 to forcibly fold the segments 4a to 4c of the rear bottom end flap 4 of the container 1 to the closed position as the latter is moved together with the article 18 loaded on the conveyor system 17. Specifically, the lever arms 24a to 24c are mounted on the shaft 28 which is located below the loading surface of the conveyor system 17, and normally assume a lower or standby position. As the container 1 reaches the forward station, this is sensed by electrical means to operate the cylinder unit 26, which turns the lever arms to their upper position shown in phantom lines in FIG. 3. The lever arms 24*a* to 24*c* have bent free ends which are located, in their upper position, to be level with the loading surface of the conveyor system 17 and to be adjacent to the rods 23*a* to 23*c*. After being folded by the turning of lever arms 24*a* to 24*c*, segments 4a to 4c of the rear end flap 4 of the container 1 pass over the rods 23*a* to 23*c* as the container 1 moves further forward, whereby they are maintained in the closed position by means of the rods 23*a* to 23*c*.

A second zone or a transfer zone comprises a conveyor system 30 including three parallel endless chains 29*a* to 29*c* which extend around pairs of sprocket gears 31, 32 and are closely spaced from the rods 23*a* to 23*c* of the first zone in alignment therewith, thereby forming a loading surface. The conveyor system 30 also includes drive means (not shown) for carrying the container 1 and the article 18 loaded thereon in the same direction as the conveyor system 17 of the first zone. To provide the required loading capability, a suitable number of support rollers 39 are mounted on pivots 34 for abutment against the lower surface of the chains 29*a* to 29*c*, the pivots 34 being carried by suitable posts (not shown). The loading surface defined by the chains 29*a* to 29*c* is level with that of the conveyor system 17, and the various segments of the forward and rear end flaps 3, 4 of the container 1 which have been folded by the closer 22 in the first zone are transferred onto the chains 29*a* to 29 *c* while maintaining the closed position. A carrier system 36 including a pair of endless chains 35*a*, 35*b* extends through the second zone and to the third zone. The carrier system 36 also includes a number of rods 37 which extend across the pair of chains 35*a*, 35*b* at a uniform spacing. The chains 35*a*, 35*b* are guided and driven by sprocket gears 38 to cause the rods 37 to follow a path of increasing height such that the latter lie below the conveyor systems 17 and 30 intermediate them, but run over the conveyor system 30 in parallel relationship therewith.

The third zone is shown in FIG. 5 where it will be noted that the carrier system 36 extending from the second zone passes therethrough. A suitable number of rollers 39 are disposed forwardly of the conveyor system 30 for receiving the container 1 and the article 18 thereon as they are conveyed from the conveyor system 30. At this end, the loading surface defined by the rollers 39 is level with that of the conveyor system 30. The rollers 39 are freely rotatable and need not be driven since the container 1 and the article 18 which have been transferred onto the rollers 39 are pushed forward by one of the rods 37 of the carrier system 36 which move over the rollers. In the third zone, the pair of bottom side flaps 5, 6 of the container 1 are folded to a closed position, which can be performed by an apparatus as illustrated in U.S. Pat. No. 3,435,738 cited above, and therefore will not be described in detail. However, briefly, the apparatus comprises a support table 40 which is located adjacent to the group of rollers 39, and plow means 42 including a pair of rods 41*a*, 41*b* located on the opposite lateral sides of the table 40, the end portions of the rods 41*a*, 41*b* being removed from each other and extending downwardly. As the container 1 is transferred from the group of rollers 39 onto the support table 40, the pair of bottom side flaps 5, 6 are folded by the plow means 42, and when the container has moved past the support table 40, the folded side flaps 5, 6 ride on the rods 41*a*, 41*b*, thus maintaining their closed position. The plow means in itself may be conventional except that they must be capable of bearing the weight of the container 1 as well as the article 18. A group of rollers 43 is shown adjacent to the other end of the plow means 42, and can be used to guide the container 1 to a known tape applicator (not shown) for the application of a tape to seal the container.

In accordance with the invention, the upper flap members can be folded during the process of folding the bottom flap members. Preferably, this may be performed in the third zone by using a conventional folding apparatus. In the embodiment shown, this apparatus is shown as comprising a plate member 44 for folding the forward end flap 7, a lever arm 45 for folding the rear end flap 8, and a pair of rods 46, 47 for folding the pair of side flaps 9, 10. The apparatus also includes a drive mechanism 49 including a double acting cylinder unit 48 which drives the arm 45. In accordance with the invention, these members can be disposed at any place from the first to third zones, but are preferably provided in the final zone because the rods 46, 47 of a reduced length can be used for maintaining the upper flap members in the closed position.

While a preferred embodiment of the invention has been illustrated and described, it should be understood that the illustration and description are exemplary only. Thus, the pair of bottom end flaps 3, 4 are each formed with a pair of slots 13*a*, 13*b* and 14*a*, 14*b*, respectively, for the purpose of description, and while this is preferred, it should be noted that the number of slots need not be limited to two. More than two slots may be formed in each bottom end flap together with the provision of an increased number of chains or tracks in the conveyor system 17 of the first zone. Various other modifications and changes will readily occur to those skilled in the art, and it is to be understood that the appended claims are intended to cover all such modifications and changes as fall within the true spirit of the invention.

Having described the invention, what is claimed is:

1. A process for packaging an article within a rectangular foldable container while on a conveyor comprising the steps of: (a) introducing an article to be packaged onto a conveyor system having at least two elevated conveyor tracks which are spaced apart and extend parallel to each other for carrying the article thereon; (b) placing a container over and around the article on the conveyor system, said container having four walls defining a container space and pairs of upper and bottom end and side flaps which extend respectively from the opposed upper and lower extremities of said walls, each of said bottom end flaps having slots therein equal in number to the number of conveyor tracks to thereby subdivide said bottom end flaps into a plurality of separately foldable segments, said bottom flaps depending in coplanar relation from the respective container walls, and said container being oriented such that the pair of bottom end flaps extend transversely of the conveyor tracks and the slots in the pair of bottom end flaps extend vertically and receive said tracks therewithin; (c) folding the pair of bottom end flaps of the container to a closed position while it is on the conveyor system; and (d) folding the remaining flaps to a closed position.

2. A process according to claim 1, in which the pair of upper end flaps and the pair of upper side flaps both extend upwardly from the walls of the container and wherein the container is placed over and around the article while the upper flaps are coplanar with the walls, and further including the steps of: (e) folding the pair of upper end flaps to a closed position, and (f) folding the pair of upper side flaps to a closed position.

3. A process according to claim 2 which includes folding the upper flaps during the process of folding the bottom flaps.

4. A packaging machine for packaging an article in an open ended foldable container having four walls defining a container space and pairs of upper and bottom end and side flaps which extend respectively from the opposed upper and lower extremities of said walls, each of said bottom end flaps having at least two slots therein to thereby subdivide such end flaps into a plurality of foldable segments, and said bottom end and side flaps depending in coplanar relation from the respective container walls, said machine comprising: (a) a conveyor system including at least two elevated conveyor tracks extending in spaced parallel relation to each other and adapted to fit within the slots formed in each bottom end flap of the container and to carry the container thereon oriented such that the pair of bottom end flaps extend transversely of the conveyor tracks and said conveyor tracks are thereby positioned within said slots; and (b) means for folding the pair of bottom end flaps to a closed position while it is on the conveyor system, said folding means including a plurality of lever arms disposed between adjacent conveyor tracks and complementarily outside both of the outermost conveyor tracks, the lever arms being mounted for pivotal motion on a common shaft which extends transversely of and below said tracks, a control mechanism being provided and including a double acting cylinder unit for driving said shaft, a plurality of rods spaced from the lever arms in the direction in which the container is adapted to travel on the conveyor system, the said rods being located in substantially aligned relationship with said lever arms relative to said conveyor tracks, said rods being positioned in a common plane and having the free ends thereof inclined downwardly; and (c) means for folding the remaining flaps of the container.

5. A packaging machine according to claim 4 in which each of said conveyor tracks comprises an endless chain which is adapted to be continuously driven at uniform and the same speed.

6. A packaging machine according to claim 4, further including (d) a second conveyor system disposed adjacent to the terminal end of the first mentioned conveyor system and including at least three spaced and parallel conveyor tracks for carrying the container thereon with its pair of bottom end flaps folded to the closed position, the conveyor tracks of said second conveyor system being located relative to the tracks of the first mentioned conveyor system so that the pair of folded bottom end flaps of the container are transferable onto the tracks of said second conveyor system; (e) said means for folding the remaining flaps of the container including means located adjacent to the terminal end of said second conveyor system for folding the pair of bottom side flaps of the container to a closed position; and (f) a carrier system for feeding the container to said means for folding the bottom side flaps.

7. A packaging machine according to claim 6 in which the carrier system comprises a pair of driven endless chains which are spaced apart and run parallel to each other, and a plurality of rods extending across and connected with the chains of the pair, the carrier system being arranged in a manner such that the rods are shifted upward at a position intermediate the first mentioned conveyor system and said second conveyor system so as to run above said second conveyor system in a substantially parallel relationship thereto.

* * * * *